United States Patent [19]

Jin et al.

[11] Patent Number: 4,536,229

[45] Date of Patent: Aug. 20, 1985

[54] FE-NI-MO MAGNET ALLOYS AND DEVICES

[75] Inventors: Sungho Jin, Millington; Thomas H. Tiefel, Piscataway, both of N.J.

[73] Assignee: AT&T Bell Laboratories, Murray Hill, N.J.

[21] Appl. No.: 550,000

[22] Filed: Nov. 8, 1983

[51] Int. Cl.[3] ..... H01F 1/04

[52] U.S. Cl. ..... 148/31.55; 148/31.57; 75/123 J; 75/123 K

[58] Field of Search ..... 148/31.55, 31.57; 75/123 J, 123 K

[56] References Cited

U.S. PATENT DOCUMENTS

| | | | |
|---|---|---|---|
| 2,105,657 | 1/1938 | Honda | 148/31.57 |
| 4,003,768 | 1/1977 | Anderson et al. | 148/31.55 |
| 4,340,435 | 7/1982 | Jin et al. | 148/31.57 |
| 4,377,797 | 3/1983 | Jin et al. | 148/31.55 |

*Primary Examiner*—John P. Sheehan

*Attorney, Agent, or Firm*—Peter A. Businger

[57] ABSTRACT

Essentially cobalt-free alloys are disclosed having a coercive force which is greater than or equal to 40 oersteds and having a magnetic squareness which is greater than or equal to 0.6. Such alloys comprise Fe, Ni, and Mo, and their approximate compositions are specified by 16–30 weight percent Ni and 3–10 weight percent Mo, remainder essentially Fe. Disclosed alloys are useful in memory and security devices.

9 Claims, No Drawings

FE-NI-MO MAGNET ALLOYS AND DEVICES

TECHNICAL FIELD

The invention is concerned with magnetic alloys and devices comprising such alloys.

BACKGROUND OF THE INVENTION

Well-established as magnet alloys are, e.g., Fe-Al-Ni-Co alloys known as Alnico, Co-Fe-V alloys known as Vicalloy, and Fe-Mo-Co alloys known as Remalloy. These alloys possess desirable magnetic properties for a variety of applications; however, they contain substantial amounts of cobalt whose uncertain availability in world markets causes concern. Moreover, high cobalt alloys tend to be brittle, i.e., to lack sufficient cold formability for shaping, e.g., by cold drawing, rolling, bending, or flattening.

Considered as relevant with respect to the invention are the following printed items:

R. M. Bozorth, *Ferromagnetism,* Van Nostrand, (1959), pp. 34–37, pp. 236–238, pp. 382–385, and p. 417;

W. S. Messkin et al., "Experimentelle Nachprufung der Akulovschen Theorie der Koerzitivkraft", *Zeitschrift fur Physik,* Vol. 98 (1936), pp. 610–623;

H. Masumoto et al., "Characteristics of Fe-Mo and Fe-W Semihard Magnet Alloys", *Journal of the Japanese Institute of Metals,* Vol. 43 (1979), pp. 506–512; and K. S. Seljesater et al., "Magnetic and Mechanical Hardness of Dispersion Hardened Iron Alloys", *Transactions of the American Society for Steel Treating,* Vol. 19, pp. 553–576.

These references are concerned with Fe-Mo binary and Fe-Mo-Co ternary alloys, their preparation, and their mechanical and magnetic properties. Phase diagrams of Fe-Mo-Ni alloys appear in:

W. Koster, "Das System Eisen-Nickel-Molybdan", *Archiv fur das Eisenhuttenwesen,* Vol. 8, No. 4 (October 1934), pp. 169–171; and

*Metals Handbook,* American Society for Metals, Vol. 8, p. 431.

Mechanical properties of Fe-Ni-Mo alloys are the subject of the following papers:

G. R. Speich, "Age-Hardening of Fe-20 (Pct) Ni Martensites", *Transactions of the Metallurgical Society of AIME,* Volume 227, (December 1963), pp. 1426–1432, and S. Jin et al., "Structure and Properties of a Microduplex Maraging Steel", *Mettalurgical Transactions A,* Volume 7A, (May 1976), pp. 637–645.

SUMMARY OF THE INVENTION

Fe-Ni-Mo alloys processed to have a predominantly ferritic structure and comprising an amount of at least 90 weight percent of Fe, Ni, and Mo in combination, with Ni being in a preferred range of 16–30 weight percent of such amount and Mo being a preferred range of 3–10 weight percent of such amount are suitable as magnet alloys, e.g., in the manufacture of memory elements and security devices.

DETAILED DESCRIPTION

An alloy of the invention more preferably comprises an amount of at least 95 or even at least 98 weight percent Fe, Ni, and Mo, and may further comprise small amounts of additives such as, e.g., Cr for the sake of enhanced corrosion resistance, or Co for the sake of enhanced magnetic properties. Other elements such as, e.g., Si, Al, Cu, V, Ti, Nb, Zr, Ta, Hf, and W may be present as impurities in individual amounts preferably less than 0.5 weight percent and in a combined amount preferably less than 2 weight percent. Similarly, elements C, N, S, P, B, H, and O are preferably kept below 0.1 weight percent individually and below 0.5 weight percent in combination. Minimization of impurities is in the interest of maintaining alloy ductility and formability. Excessive amounts of elements mentioned may be detrimental to magnetic properties, e.g., due to lowering of saturation induction.

Alloys of the invention may be prepared, e.g., by casting from a melt of constituent elements Fe, Mo, and Ni in a crucible or furnace such as, e.g., an induction furnace; alternatively, a metallic body having a composition within the specified range may be prepared by powder metallurgy. Preparation of an alloy and, in particular, preparation by casting from a melt, calls for care to guard against inclusion of excessive amounts of impurities as may originate from raw materials, from the furnace, or from the atmosphere above the melt. To minimize oxidation or excessive inclusion of nitrogen, it is desirable to prepare a melt with slag protection, in a vacuum, or in an inert atmosphere.

Cast ingots of an alloy of the invention may typically be processed by hot working, cold working, and solution annealing for purposes such as, e.g., homogenization, grain refining, shaping, or the development of desirable mechanical properties.

In accordance with the invention, Fe-Ni-Mo alloys suitable for magnet alloys have a so-called microduplex multi-phase structure which is aligned and elongated and which can be produced by thermomechanical processing comprising plastic deformation, heating to produce two-phase decomposition, additional deformation, and final low-temperature precipitation aging. The resulting alloys are ductile and easy to process and, in the final aged condition, have high tensile strength.

Processing parameters are conveniently chosen in the following approximate ranges:

initial deformation by methods such as, e.g., rolling, drawing, or swaging is preferably by an amount corresponding to an area reduction in the range of from 20 to 80 percent;

subsequent aging in a multi-phase, alpha plus gamma plus precipitate region is preferably at a temperature in the range of from 600 to 700 degrees C. for a duration of from 10 minutes to 5 hours. As a result of such aging, a preferred amount in the range of from 30–70 weight percent of the alloy is of gamma or gamma plus precipitate phase.

Additional deformation after initial aging is preferably by an amount corresponding to an area reduction in the range of from 50 to 98 percent, and final aging is at preferred temperatures in a range of from 500 to 600 degrees C. for a time in the preferred range of from 10 minutes to 5 hours. As a result of final aging, gamma phase as may be lost in the course of deformation, is recovered, and the final alloy again has preferred 30–70 weight percent gamma or gamma plus precipitate.

The processed alloy has deformed microstructure in which particles have a preferred aspect ratio which is greater than or equal to 2 and preferably greater than or equal to 5. Preferred coercivity is greater than or equal to 40 oersteds and preferably greater than or equal to 100 oersteds. Preferred magnetic squareness is greater than or equal to 0.6 and preferably greater than or equal to 0.7. The alloy has a 0.2 percent offset yield strength which typically is greater than 100,000 psi, and tensile elongation typically greater than 5 percent.

Without limiting the invention, the following metallurgical mechanism is suggested to elucidate transformations caused by thermomechanical processing for producing the above-mentioned microduplex structure:

Cooling to room temperature of a cast ingot causes a martensitic phase transformation from a paramagnetic or weakly magnetic gamma phase to a ferromagnetic alpha prime (martensite) phase. Initial cold working serves to transform any retained nonmagnetic phase to martensite and to accelerate the subsequent two-phase decomposition which takes place upon heating in an (alpha plus gamma) two-phase region. Such heat treatment establishes the microduplex structure and also causes the formation of coherent precipitates, believed to be $Ni_3Mo$, in the alpha phase. Final deformation serves to elongate and align the two-phase structure which now is essentially alpha plus alpha prime. Final lower-temperature aging causes either partial reversion of martensite to gamma or further induces the formation of gamma at the interface of elongated alpha plus alpha prime or alpha plus gamma phase particles.

Alloys of the invention are particularly useful in the manufacture of memory and security devices such as, e.g., anti-theft alarm systems. PMT (permanent magnet twister) memory application of alloys of the invention may proceed as follows. An alloy is hot rolled and cold rolled into a thin sheet of about 0.001 inch thickness and may be either annealed and aged or annealed, lightly cold rolled, and aged. The sheet is bonded with an epoxy polyamide adhesive to an about 16 mil thick aluminum support card. An asphaltic etch resist is then screen printed onto the alloy to form a matrix of square and rectangular magnets. Areas not covered with the resist are then chemically etched away, using solutions containing, e.g., ammonium persulfate or sodium persulfate. In the interest of reasonable commercial processing speed, etching should be completed within minutes and preferably within 5 minutes at a temperature near 50 degrees C. The chemical etching solution for the Fe-Mo-Ni magnet is such as not to etch the aluminum support card. Each card (approximately 6 inches×11 inches) comprises 2880 magnets measuring 35 to 40 mil square and 65 rectangular magnets measuring 20×128 mils.

EXAMPLE 1

A strip of Fe-Ni-Mo alloy having a thickness of approximately 0.2 inches and a width of approximately 2 inches and comprising approximately 20 weight percent Ni, approximately 4 weight percent Mo, and remainder essentially Fe was cold rolled to 53 percent area reduction, heated at a temperature of approximately 650 degrees C. for approximately 4.5 hours, cold rolled to 97 percent area reduction, and heated at a temperature of approximately 575 degrees C. for approximately 45 minutes. The processed alloy had a magnetic remanence of 5000 gauss, a coercivity of 190 oersteds and a magnetic squareness of 0.61.

EXAMPLE 2

An alloy of the composition as described in Example 1 above was processed by wire drawing to 78 percent area reduction, heating at a temperature of 650 degrees C. for 4 hours, wire drawing to 85 percent area reduction, and heating at a temperature of approximately 500 degrees C. for 2 hours. The processed alloy had a magnetic remanence of 15,000 gauss, coercivity of 41 oersteds, and a magnetic squareness of 0.96.

EXAMPLE 3

An Fe-Ni-Mo alloy comprising approximately 20 weight percent Ni and approximately 6 weight percent Mo, and remainder essentially Fe was cold rolled to 50 area reduction, heated at a temperature of approximately 650 degrees C. for approximately 4.5 hours, cold rolled to an area reduction of 90 percent, and heated at a temperature of approximately 575 degrees C. for approximately 20 minutes. The processed alloy had a magnetic remanence of 4400 gauss, a coercivity of 220 oersteds, and a magnetic squareness of 0.77.

EXAMPLE 4

An alloy having the composition as described in Example 3 above was processed by cold rolling to 75 percent area reduction, heating at a temperature of approximately 650 degrees C. for approximately 4.5 hours, cold rolling to 96 percent area reduction, and heating at a temperature of approximately 575 degrees C. for approximately 20 minutes. The processed alloy had a magnetic remanence of 4300 gauss, a coercivity of 210 oersteds, and a magnetic squareness of 0.74.

What is claimed is:

1. Device comprising a body of a magnetic alloy having a coercive force which is greater than or equal to 40 oersteds and a magnetic squareness which is greater than or equal to 0.6, said device being characterized in that said alloy comprises Fe, Ni, and Mo in a combined amount which is greater than or equal to 95 weight percent of said body, Ni content of said alloy being in the range of 16–30 weight percent of said combined amount, Mo content of said alloy in the range of from 3–10 weight percent of said combined amount, and each of the elements Si, Al, Cu, V, Ti, Nb, Zr, Ta, Hf, and W being present in said alloy in an amount which is less than 0.5 weight percent of said combined amount.

2. Device of claim 1 in which said alloy has a coercive force which is greater than or equal to 100 oersteds.

3. Device of claim 1 in which said alloy has a magnetic squareness which is greater than or equal to 0.7.

4. Device of claim 1 in which said combined amount is greater than or equal to 98 weight percent of said body.

5. Device of claim 1, said device being a magnetic memory.

6. Device of claim 1, said device being a security device.

7. Device of claim 6, said device being an anti-theft device.

8. Magnetic alloy having a coercive force which is greater than or equal 40 oersteds and a magnetic squareness which is greater than or equal to 0.6, said alloy being characterized in that said alloy comprises Fe, Ni, and Mo in a combined amount which is greater than or equal to 95 weight percent of said body, Ni content of said alloy being in the range of 16–30 weight percent of said combined amount, and Mo content of said alloy being in the range of from 3–10 weight percent of said combined amount, and each of the elements Si, Al, Cu, V, Ti, Nb, Zr, Ta, Hf, and W being present in said alloy in an amount which in less than 0.5 weight percent of said combined amount.

9. Magnetic alloy of claim 8 in which said alloy has a coercive force which is greater than or equal to 100 oersteds and a magnetic squareness which is greater than or equal to 0.7.

* * * * *